US006303852B1

(12) United States Patent
Kizaki et al.

(10) Patent No.: US 6,303,852 B1
(45) Date of Patent: Oct. 16, 2001

(54) APPARATUS AND METHOD FOR SYNTHESIZING MUSICAL TONES USING EXTENDED TONE COLOR SETTINGS

(75) Inventors: Takahiro Kizaki; Takeshi Mori, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/546,572

(22) Filed: Apr. 10, 2000

(30) Foreign Application Priority Data

Jun. 25, 1999 (JP) ..... 11-179482

(51) Int. Cl.[7] ..... G10H 1/06; G10H 7/00
(52) U.S. Cl. ..... 84/622; 84/645; 84/659
(58) Field of Search ..... 84/622–625, 645, 84/659–661

(56) References Cited

U.S. PATENT DOCUMENTS 5,345,035 * 9/1994 Yamada ..... 84/622
5,554,814 * 9/1996 Nakata ..... 84/659
5,864,081 * 1/1999 Iwase et al. ..... 84/622

FOREIGN PATENT DOCUMENTS 10-319954 12/1998 (JP) .

* cited by examiner

*Primary Examiner*—Stanley J. Witkowski
(74) *Attorney, Agent, or Firm*—Morrison & Foerster

(57) ABSTRACT

A musical tone synthesizing apparatus and method are provided to enable automatic addition of parts in response to addition of extended tone colors. Herein, prescribed tone colors are set to the tone-generation instructors, which are respectively assigned to performance inputs for inputting performance data from designated devices such as a keyboard, a sequencer and other MIDI instruments or devices. The tone-generation instructors produce output performance data based on which a tone generator generates corresponding musical tone signals. Addition of the extended tone colors can be actualized by installation of an extended board into an extended slot. Upon detection of the addition of the extended tone colors at a start of system, the apparatus automatically extends tone-generation instructors so that a user is capable of selecting the extended tone colors for the extended tone generation instructors, respectively. In addition, the user is capable of editing the extended tone colors to produce extended tone color edit data.

28 Claims, 10 Drawing Sheets

APPARATUS AND METHOD FOR SYNTHESIZING MUSICAL TONES USING EXTENDED TONE COLOR SETTINGS

BACKGROUND OF THE INVENTION

1. Field of the Invention

This invention relates to musical tone synthesizing apparatuses and methods that produce multiple sets of performance data each having a specific tone color being arbitrarily set, and particularly to musical tone synthesizing apparatuses and methods in which a variety of tone colors can be additionally set as extended tone colors and which are capable of managing extended sound sources.

This application is based on Patent Application No. Hei 11-179482 filed in Japan, the content of which is incorporated herein by reference.

2. Description of the Related Art

Recently, engineers and manufacturers develop and produce a variety of musical tone synthesizing apparatuses such as electronic musical instruments in a variety of models. Herein, each model of the musical tone synthesizing apparatus is capable of setting various tone colors, a number of which is determined in advance. To further increase the number of the tone colors being set, the conventional apparatuses are connected with other instruments and devices (e.g., other electronic musical instruments and other sound sources), which are capable of handling other tone colors being added, by way of prescribed interfaces of MIDI (where "MIDI" is an abbreviation for the known standard of "Musical Instrument Digital Interface"). Herein, increasing the number of the tone colors is actualized by controlling the instruments and devices in accordance with MIDI protocols. Concretely speaking, tone colors are being changed over in such a way that MIDI program change instructions for instructing changes of tone colors are transmitted to multiple electronic musical instruments or sound sources. Actually, however, users (e.g., human operators and performers) intend to actualize tone generation using the tone color being selected by a certain electronic musical instrument or sound source. For this reason, it is necessary to perform prescribed setting in advance that other electronic musical instruments or other sound sources do not actually produce sounds even when they receive the MIDI program change instructions. However, it is very troublesome for the user to perform the aforementioned setting with respect to each instrument or device every time the MIDI program change instruction is being issued.

To cope with the aforementioned drawbacks, engineers recently develop electronic musical instruments whose main bodies are equipped with extended slots for installing extended boards used for adding tone colors in advance. That is, the extended slots are capable of storing the extended boards such as sound boards that have same structures of the pre-installed tone generators. Or, the extended slots are capable of storing sound boards that store and handle extended tone colors. Herein, the tone colors are extended in such a way that the boards are directly interconnected with main controls of the electronic musical instruments by way of main buses without intervention of MIDI interfaces. In addition, the users are capable of handling the "extended" tone colors as similar to "preset (or main)" tone colors by using manual operators (e.g., switches and controls) on operation panels of main bodies of the electronic musical instruments. Thus, it is possible to add the desired tone color(s) to the electronic musical instrument without performing "troublesome" setting works, which are described above.

The extended tone colors, which are being extended using the sound boards installed in the extended slots, are used as "alternative" tone colors or "additional" tone colors in comparison with "preset" tone colors which are preset to a main tone generator of the electronic musical instrument. That is, each of the extended tone colors has two functions, i.e., an alternative function and an addition function. For example, the alternative function is described as follows:

Suppose that a prescribed tone color of a piano being preset in the main body is normally designated by a tone color number "1". In that case, if the sound board is installed in the extended slot of the main body of the electronic musical instrument, the tone color number "1" is somewhat changed to designate a high-quality tone color of the piano (or version-up tone color data of the piano) stored on the sound board.

In addition, the addition function controls the electronic musical instrument to construct an tone-color addition system in which the additional tone color is newly added to consecutively follow the preset tone colors and is given a new tone color number serially following the tone color numbers already used in the main body.

The aforementioned technique (i.e., addition of tone colors by installation of the sound board in the extended slot) merely provides extension of tone colors, so it lacks concrete tone-generation instructors for instructing generation of musical tones using the extended tone colors. In other words, the aforementioned technique merely broadens a range for selection of tone colors, however, it fails to effectively use the extended tone colors. That is, the main body of the existing electronic musical instrument is designed to set a certain number of parts for the tone-generation instructors in advance, wherein the tone colors are allocated to the parts respectively, for example. So, if the electronic musical instrument itself is regarded as an orchestra (or band), the aforementioned technique for the addition of tone colors using the board installed in the extended slot is construed as an increase of a number of instruments (or tone colors) being usable in the orchestra (or electronic musical instrument). In other words, it does not contribute to addition of parts, i.e., addition of performers, players or members playing the instruments in the orchestra. To play the music with the extended tone color, it is necessary to use the part, which is originally used for generation of musical tones using the preset tone color, for generation of musical tones using the extended tone color. In short, the electronic musical instrument employing the aforementioned technique is insufficient to demonstrate depths and effects of the music being played with instruments.

SUMMARY OF THE INVENTION

It is an object of the invention to provide a musical tone synthesizing apparatus or method that is capable of automatically adding tone-generation instructors (e.g., parts) in response to extension (or addition) of tone colors.

It is another object of the invention to provide a musical tone synthesizing apparatus or method that is capable of editing, storing and managing data with regard to extended tone colors.

A musical tone synthesizing apparatus (or method) of this invention is designed to enable automatic addition of parts (or tone-generation instructors) in response to addition of extended tone colors. Herein, prescribed tone colors are set to the tone-generation instructors (i.e., main parts), which are respectively assigned to performance inputs for inputting performance data from designated devices such as a keyboard, a sequencer and other MIDI instruments or devices. Thus, the tone-generation instructors produce output performance data, based on which a tone generator generates corresponding musical tone signals. Addition of the extended tone colors is actualized by installation of an extended board into an extended slot, for example. Upon detection of the addition of the extended tone colors at a start of system, the apparatus automatically extends tone-generation instructors (i.e., additional parts) further more, so that a user is capable of selecting the extended tone colors for the extended tone-generation instructors respectively. In addition, the user is capable of editing the extended tone colors to produce extended tone color edit data. The extended tone color edit data are saved on an external storage device (e.g., semiconductor memory card) together with an ID of the extended board or else. Thereafter, the extended tone color edit data once saved on the external storage device are loaded to the extended board specified by the ID at the start of the system.

Specifically, when a main body of the musical tone synthesizing apparatus installs a sound board in an extended slot thereof to detect addition of extended tone colors, the musical tone synthesizing apparatus is capable of automatically producing extended tone-generation instructors (i.e., additional parts) in addition to the existing tone-generation instructors (i.e., main parts). So, it is possible to automatically set the extended tone colors to desired parts. For example, an extended tone color is selected for an additional part, which is being connected with a prescribed performance input. Thus, the additional part is used exclusively for generation of musical tones with regard to the extended tone color. In that case, it is possible to actualize generation of musical tones having the extended tone color without changing contents of the main parts. This simplifies tone color setting operations for the user. Assuming the musical tone synthesizing apparatus as an orchestra, for example, the aforementioned technique contributes to automatic addition of members or players (i.e., parts), which is distinguished from the conventional apparatus merely contributing to addition of instruments (i.e., tone colors). That is, this technique allows original members of the orchestra (i.e., parts) to play their original instruments while adding new players for playing new instruments.

The aforementioned technique can be modified such that all tone color numbers representing all tone colors including the extended tone colors are re-assigned to all parts including the main parts and additional parts. This enables comprehensive tone color setting for the user. That is, each of the players (or parts) is capable of selecting an instrument from among all instruments including the added instruments (or all tone colors including the extended tone colors), regardless of original assignment. That is, it is possible to re-organize the orchestra to include new instruments and new members.

The extended tone color edit data are produced by the edit of the extended tone colors with respect to the tone-generation instructors (or parts). Then, the extended tone color edit data are stored in the sound board being additionally installed in the extended slot, for example. Normally, however, the manufacture does not guarantee safety in retaining stored contents of an internal storage of the sound board. Similarly, there is a probability in that extended tone colors, which are added in a software manner by a software tone generator and are being edited, are stored in prescribed areas, stored contents of which are not necessarily guaranteed in safety. To cope with such disadvantages, this invention is designed such that after completion of the edit or after completion of application programs, the extended tone color edit data are saved on the external storage device together with an ID of the sound board or else. At a power-on event, the apparatus automatically loads the extended tone color edit data to the sound board or else being specified by the ID. As a result, it is possible to well manage the extended tone colors and their edit data, which are inhibited from being deleted with inattention.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in detail by way of examples with reference to the accompanying drawings.

[A] Hardware

Figure 1:
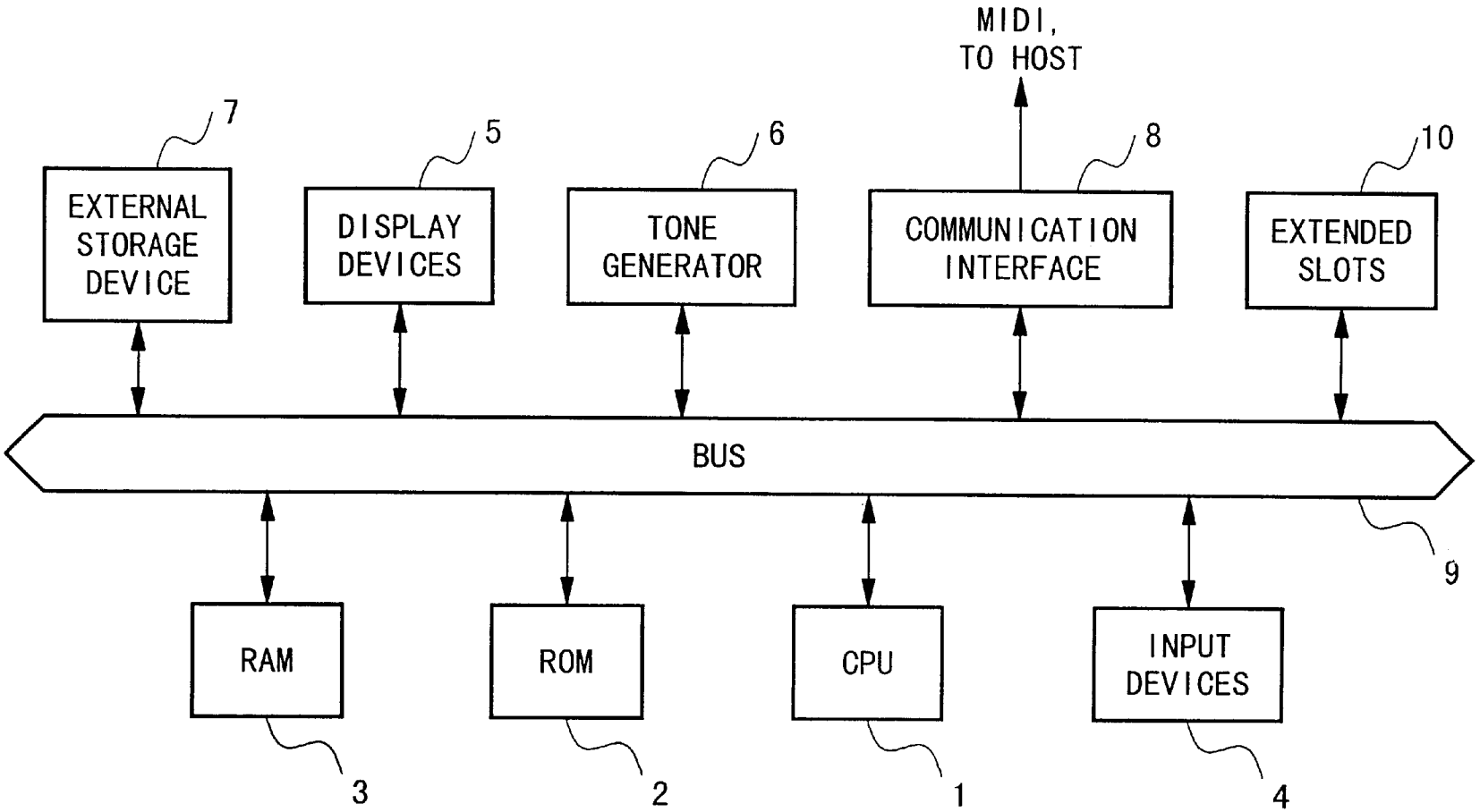
FIG. 1 is a block diagram diagrammatically showing a basic configuration in hardware of a musical tone synthesizing apparatus in accordance with preferred embodiment of the invention.
Figure 2:
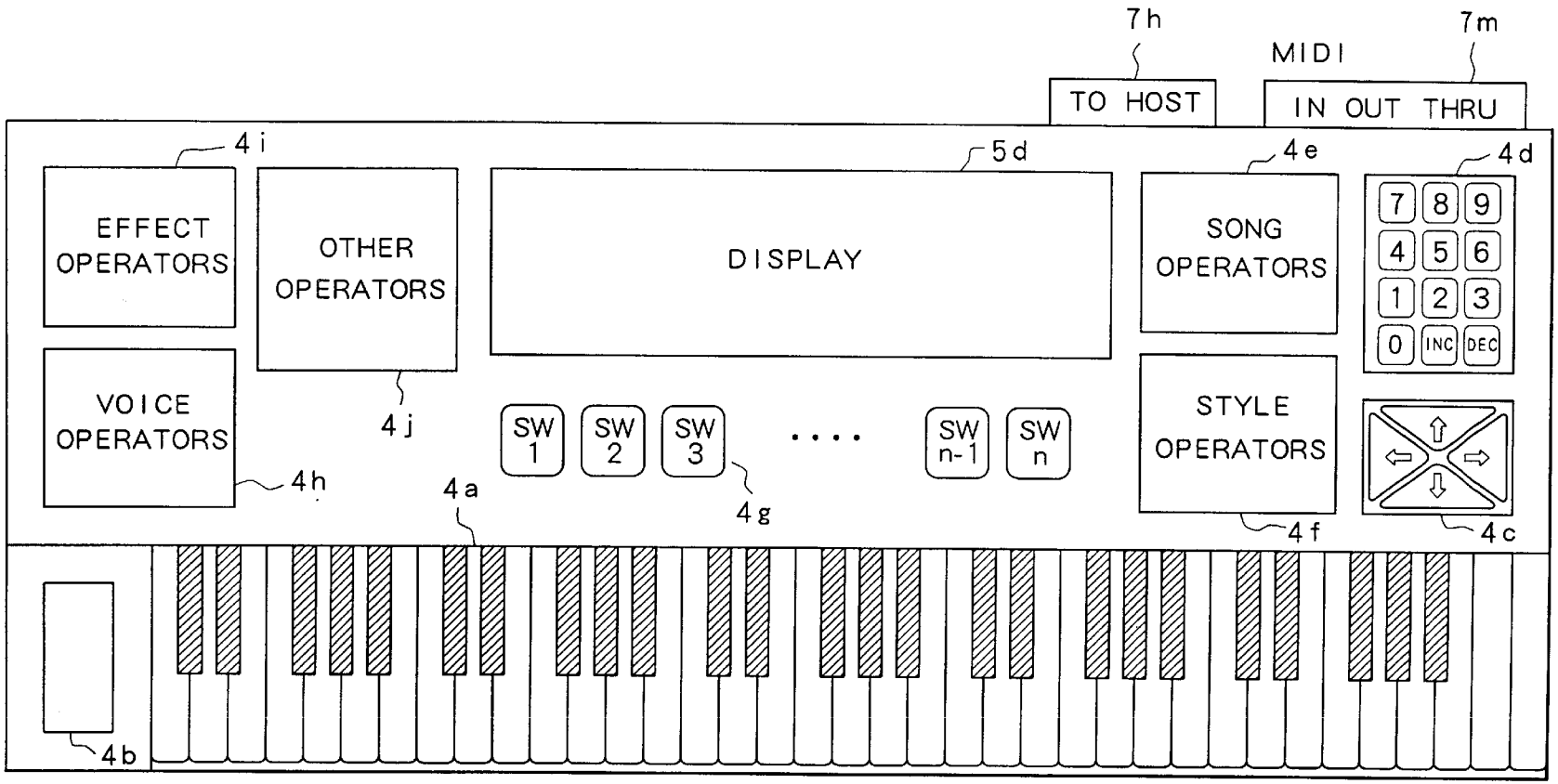
FIG. 2 is a plan view showing an operation console of an electronic musical instrument actualizing functions of the musical tone synthesizing apparatus of FIG. 1.

FIG. 1 is a block diagram diagrammatically showing a basic configuration in hardware of a musical tone synthesizing apparatus in accordance with one embodiment of the invention. The musical tone synthesizing apparatus of FIG. 1 contains a central processing unit (CPU) 1, a read-only memory (ROM) 2, a random-access memory (RAM) 3, input devices 4, display devices 5, a tone generator 6, a communication interface (I/F) 7 and an external storage device 8, all of which are interconnected with each other by way of a bus 9. The bus 9 is further interconnected with an extended slot 10. Functions of the musical tone synthesizing apparatus can be actualized in form of an electronic musical instrument, for example. FIG. 2 is a plan view showing an operation console or panel of such an electronic musical instrument. Of course, the musical tone synthesizing apparatus is not necessarily actualized in the form of the electronic musical instrument. Therefore, functions of the musical tone synthesizing apparatus can be actualized in a form of a personal computer that has an extended slot (10), for example.

The CPU 1 performs a variety of controls on the musical tone synthesizing apparatus in accordance with prescribed programs. Namely, the CPU 1 centrally performs a variety of data processing particularly with regard to tone-generation processes for performance data and processes regarding extended tone colors, which will be described later. The ROM 2 stores prescribed control programs, according to which the data processing is being executed. The control programs contain a variety of data processing programs, tables and data, which actualize functions of this invention. The RAM 3 stores data and parameters which are required for execution of the data processing. In addition, the RAM 3 is used as a work area for temporarily storing registers and flags as well as data being processed.

The input devices 4 contain manual operators 4*a*, 4*b* used for musical performance, wherein "4*a*" designates keys of a keyboard. In addition, the input devices 4 contain a variety of manual operators 4*c* to 4*j* such as switches, controls and wheels (or sliders) which are used to set control functions of performance data such as modes, parameters and effects, for example. The display devices 5 contain a display 5*d* and indicators (not shown). The keys of the keyboard 4a are split into multiple registers, a number of which is designated by an integer "p". So, performance data being input to the musical tone synthesizing apparatus are assigned with "p" keyboard channels KBch1 to KBchp in connection with the registers of the keyboard 4*a* respectively. Incidentally, the musical tone synthesizing apparatus has functions of an internal sequencer, which is capable of dealing with a prescribed number of tracks therein. So, performance data of the internal sequencer are related to a number of sequencer channels, which coincides with a number of the tracks. That is, the performance data of the internal sequencer are assigned with "q" sequencer channels SQch1 to SQchq respectively, wherein "q" is an integer.

If the musical tone synthesizing apparatus is actualized in the form of the electronic musical instrument as shown in FIG. 2, the display 5*d* can be arranged on an operation panel together with the manual operators 4*a* to 4*j*. In the case of FIG. 2, the keyboard 4*a* used for the musical performance is arranged in a front portion of the operation panel together with the manual operators 4*b* used for controlling performance effects such as pitch bend and modulation. Other switches, keys and operators (4*c*–4*h*) are arranged around the display 5*d*, which is arranged at a center of an upper portion of the operation panel. That is, the operation panel contains cursor keys 4*c*, a ten-key unit 4*d* including numeric keypads for inputting numerical values, song operators 4*e* used for the sequencer, accompaniment style operators 4*f*, and function select switches 4*g* such as a play switch SW1, a direct switch SW2 and a system switch SW3. Herein, a desired function is being selected by one operation applied to a certain function select switch (4*g*). In addition, the operation panel contains voice operators 4*h* for selecting and editing tone colors, DSP operators (or effect operators) 4*i* used for effect processes (where "DSP" is an abbreviation for "Digital Signal Processor"), and other operators 4*j* containing a master volume control, for example. If the musical tone synthesizing apparatus is actualized in a form of a personal computer, keys of a computer keyboard, a mouse and buttons on a display are substituted for the aforementioned manual operators 4*a* to 4*j* of the input devices shown in FIG. 2.

In FIG. 1, the tone generator 6 generates musical tones based on output performance data which are processed by the musical tone synthesizing apparatus. The tone generator 6 can be configured by a "hardware" tone generator using a tone generator driver, a tone generator LSI device or else. Or, it can be actualized by a "software" tone generator using software processing.

The communication interface (I/F) 7 is configured by a MIDI interface and a TO HOST interface. Herein, the MIDI interface is used for communications being effected between the musical tone synthesizing apparatus and other MIDI devices in MIDI formats, while the TO HOST interface is used for communications being effected between the musical tone synthesizing apparatus and a host computer (not shown). In addition, the MIDI interface has MIDI terminals 7*m* such as IN, OUT, THRU, while the TO HOST interface has a TO HOST terminal 7*h*. As shown in FIG. 2, those terminals 7*m*, 7*h* are arranged in a rear panel. So, it is possible to provide multiple sets of those terminals respectively.

Normally, the MIDI standard regulates a number of channels with respect to each cable or each terminal. Specifically, it sets sixteen channels for a single cable or a terminal. By providing multiple sets of the MIDI terminals 7*m*, it is possible to increase the number of the channels inside of the apparatus. Suppose that the musical tone synthesizing apparatus is equipped with two sets of the MIDI terminals 7*m*, for example. In this case, data of sixteen channels (i.e., channel 1 to channel 16) being input to a first input terminal of "MIDI IN 1" within the first set of MIDI terminals are directly used as data of sixteen MIDI channels (i.e., MIDIch1 to MIDIch16) inside of the apparatus. In addition, data of other sixteen channels (i.e., channel 1 to channel 16) being input to a second input terminal of "MIDI IN 2" within the second set of MIDI terminals are used as data of consecutively numbered sixteen MIDI channels (i.e., MIDIch17 to MIDIch32) inside of the apparatus. Similarly, it is possible to increase a number of channels with respect to data of a high transfer rate, which are transferred between the musical tone synthesizing apparatus and host computer by way of the TO HOST terminal 7*h*. In that case, "virtual" MIDI channels can be assigned to the data of the TO HOST terminal(s). As described above, it is possible to assign the performance data being input by way of the communication interface 7 with "r" MIDI channels MIDIch1 to MIDIchr (where "r" is an integer arbitrarily selected).

The external storage device 8 is configured by any kinds of storage devices such as hard disk drives (HDD), semiconductor memory card (e.g., smart media) drives, CD-ROM drives (where "CD-ROM" is an abbreviation for "Compact Disk-Read-Only Memory"), floppy disk drives (FDD), magneto-optic (MO) disk drives and digital versatile disk (DVD) drives, for example. The external storage device 8 is capable of storing a variety of control programs and data. Therefore, storage of programs and data being required for reproduction of performance data is not necessarily limited to the ROM 2, so it is possible to load the programs and data from the external storage device 8 to the RAM 3. In that case, it is possible to record processing results on recording media of the external storage device 8 according to needs. Particularly, portable high-density storage media, whose sizes are smaller than the known semiconductor memory cards, are suitable for storing extended tone color edit data of this invention.

It is possible to install sound boards (or extended boards) in the extended slots (10). As the extended boards, it is possible to use sound boards, which are used for extended tone colors and which have substantially the same structure of the tone generator (6) of the main body, and other sound boards storing extended tone colors. By inserting the extended board into the extended slot 10, it is possible to add a number of tone colors, which can be handled by the main body of the musical tone synthesizing apparatus. Such addition of the tone colors is not necessarily actualized in a hardware manner that the extended board is inserted into the extended slot 10 as shown in FIG. 1. In other words, it is possible to actualize the addition of the tone colors in a software manner that some application programs (and data) are additionally installed in the software tone generator.

[B] Tone-generation Process of Input Performance Data

Figure 3:
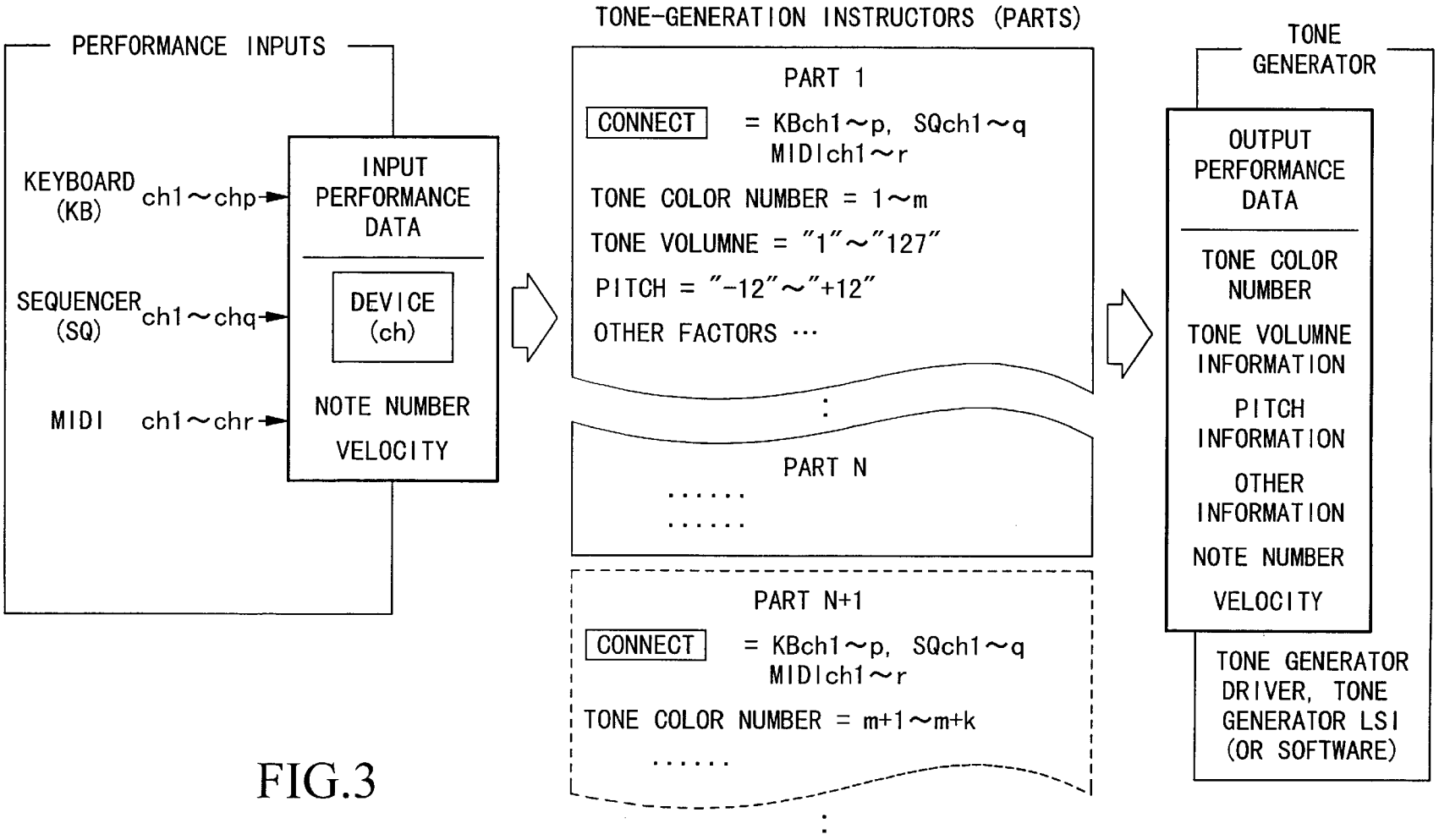
FIG. 3 shows relationships between performance inputs, tone-generation instructors (parts) and a tone generator.
Figure 4:
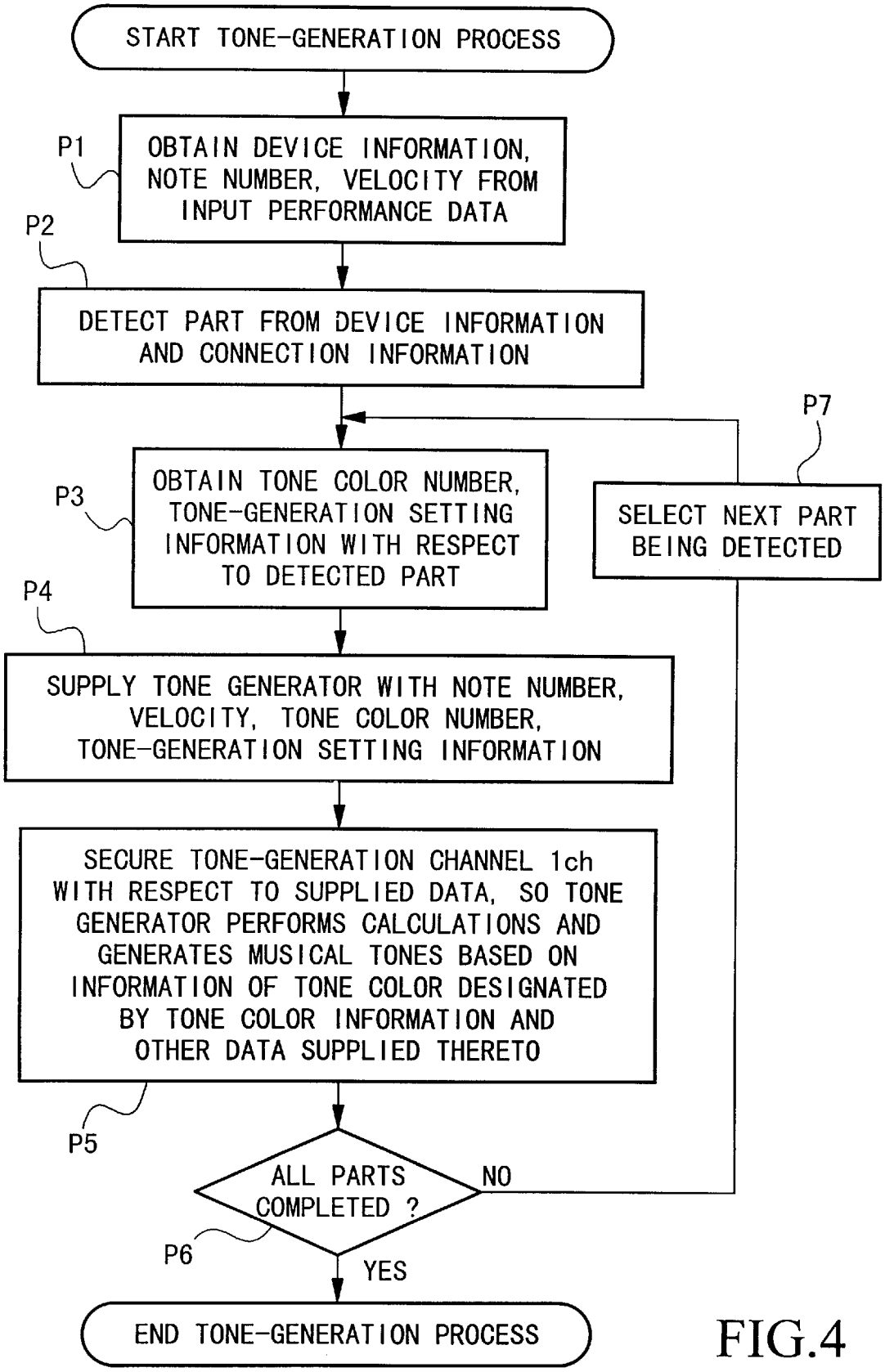
FIG. 4 is a flowchart showing a tone-generation process of input performance data.

FIG. 3 shows relationships between performance inputs, tone-generation instructors (e.g., parts) and tone generator in a tone-generation process, content of which is shown by a flowchart of FIG. 4 and is made in accordance with an embodiment of the invention. In FIG. 3, the performance inputs correspond to the keyboard 4*a* and internal sequencer as well as other MIDI devices and host computer, which are connected with the main body by way of the communication interface 7. Herein, the performance inputs configure reception buffer channels. So, performance data having note numbers and velocity information are input to the tone-generation instructors. The input performance data are divided in response to channels respectively. Specifically, the present musical tone synthesizing apparatus inputs a variety of performance data over the "p" keyboard channels KBch1-KBchp from the keyboard 4*a*, "q" sequencer channels SQch1-SQchq from the internal sequencer, and "r" MIDI channels MIDIch1-MIDIchr from the MIDI terminal 7*m* and TO HOST terminal 7*h* of the communication interface 7. Those channels provide the main body with device information of the input performance data.

The tone-generation instructors of the musical tone synthesizing apparatus (e.g., electronic musical instrument) have data named "parts". Herein, a number of the parts depends upon each model of the musical tone synthesizing apparatus. Each of the parts is capable of determining the reception buffer channels within the performance inputs, or each of them can be connected with each of the channels within the performance inputs. So, it is possible to set connect information for assigning at least one of the channels of the performance inputs as connect destination ("connect" in FIG. 3). In some cases, multiple parts simultaneously designate the same connect destination. Each part is capable of setting "part tone generation setting information" in addition to tone color information (or program change information) indicating representation as to which tone color is used to generate musical tones. As the part tone generation setting information, it is possible to use tone volume information, pitch control information, and other information such as send values of effects.

For example, FIG. 3 shows "N" parts, each encompassed by a solid line, which are normally set to the main body, wherein "N" is an arbitrarily selected integer which frequently corresponds to "16", "32" and "64". As "connect" (i.e., connect destination) being set to each of the parts 1 to N of the main body, it is possible to assign one of the "p" keyboard channels KBch1-KBchp, "q" sequencer channels SQch1-SQchq and "r" MIDI channels MIDIch1-MIDIchr, which is designated by the device information of the input performance data. As "tone color" being set to each of the parts 1 to N of the main body, it is possible to set one of "m" preset tone colors being preset to the main body by one of tone color numbers "0" to "m". As "tone volume" being set to each part, it is possible to set one of one hundred and twenty eight levels by one of numeric values "0" to "127". As "pitch" which is used for pitch control with respect to each part, it is possible to set one of twenty-five levels by one of numeric values "−12" (indicating a minimal level) to "+12" (indicating a maximal level).

Figure 5A:
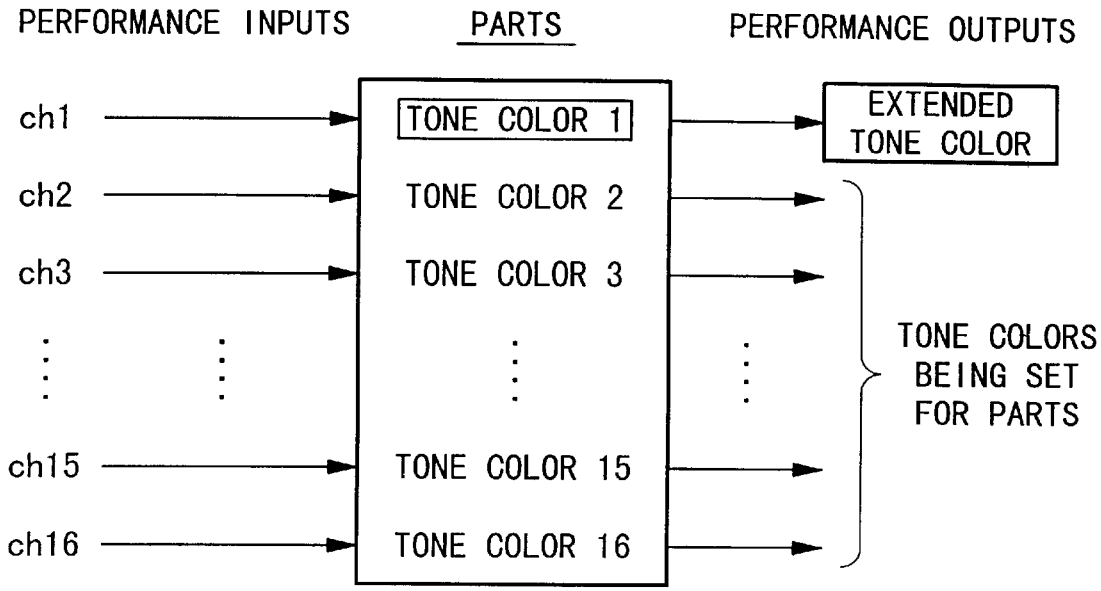
FIG. 5A is a schematic diagram for explaining addition of an extended tone color by a conventional apparatus.

Suppose that "k" extended tone colors (where "k" is an integer arbitrarily selected) are added to the "m" preset tone colors by installing the extended board in the extended slot 10. In that case, the conventional apparatus is designed to merely extend a range of tone color numbers, which are selectable by the parts 1 to N of the main body (each encompassed by a solid line in FIG. 3) from "m" to "m+k". This will be explained in a concrete manner using an example of FIG. 5A, as follows:

In FIG. 5A, connect destinations are respectively set to sixteen channels ch1 to ch16 by device information of input performance data, so that sixteen parts (i.e., N=16) are normally configured in response to sixteen tone color numbers "1" to "16" (i.e., m=16) respectively. Then, another extended tone color (i.e., k=1) is added by installing an extended board in the extended slot 10. In response to installation of the extended board, the tone color (i.e., tone color number 1) of the part is alternatively changed over to the extended tone color, for example.

Figure 5B:
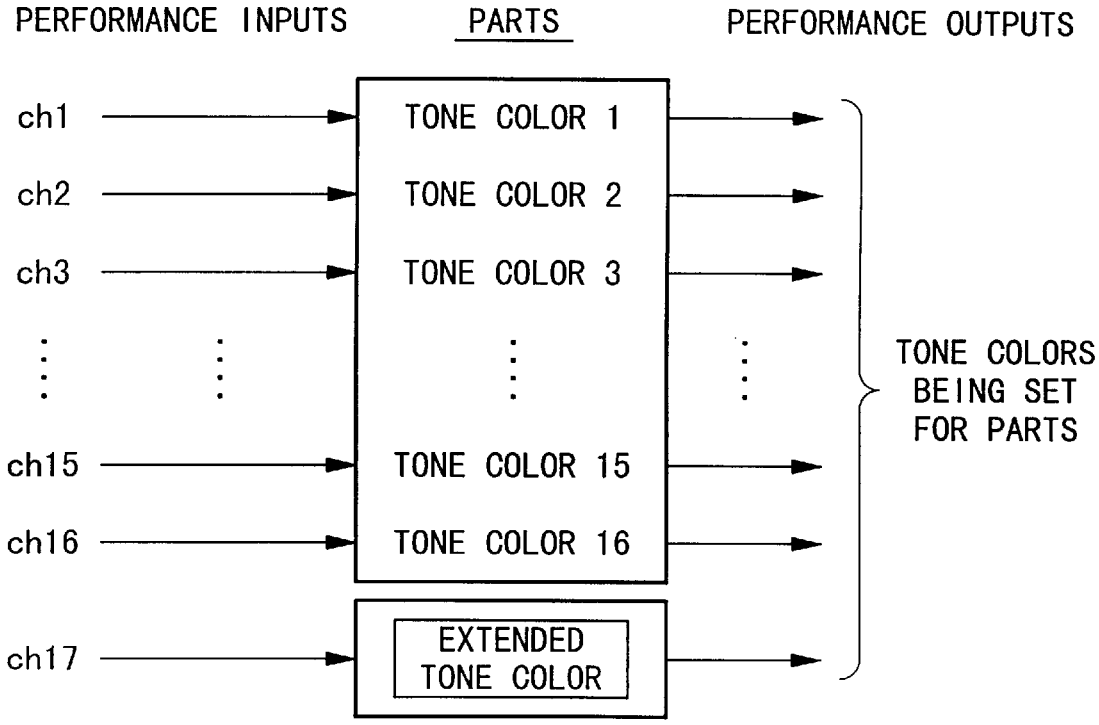
FIG. 5B is a schematic diagram for explaining addition of an extended tone color by the apparatus of the embodiment.

In contast to the conventional apparatus, the present embodiment works to automatically add a new part, which is encompassed by a dotted line in FIG. 3. That is, the present embodiment automatically produces at least one additional part "N+i" (where i≧1) in addition to the existing parts 1 to N. The additional part N+i is capable of setting a new tone color number within "m+1" to "m+k" for the extended tone color(s), or the new tone color number is selected from among "m+1" to "m+k" if k≧2. This is explained in a concrete manner using the aforementioned example in which parts (N=16) of the main body are normally configured by assigning tone color numbers 1–16 (m=16) to channels ch1ch16 of the input performance data respectively. In that case, if an extended tone color (k=1) is added by installation of an extended board, the present embodiment operates as shown in FIG. 5B. That is, the present embodiment is capable of automatically producing a new additional part (i=1) in response to the extended tone color newly added.

Incidentally, the additional part N+i is not necessarily limited to one, i.e., "N+1". So, it is possible to arbitrarily increase a number of additional parts, which are designated by reference numerals "N+1" to "N+i" (where i ≧2), in response to a number of extended tone colors which can be added to the preset tone colors in the main body. Setting information for the additional part N+i newly increased is basically similar to the aforementioned setting information, which is used by the "original" parts originally set to the main body, except "tone color number" being extended.

Details of the present embodiment will be described later, wherein the present embodiment is basically designed to avoid multiple selection of tone colors between the original parts and additional part(s), as follows:

That is, the present embodiment inhibits the original parts 1–N of the main body from selecting the extended tone color(s), while the present embodiment allows the additional part(s) N+i to select only the extended tone color(s). Thus, the present embodiment simplifies operations for setting tone colors with respect to the additional part(s) N+i.

Of course, it is possible to modify the present embodiment to operate in a comprehensive tone color setting manner. That is, the present embodiment is re-designed such that all of tone color numbers including the newly extended tone color(s) are set again with respect to all of the parts 1 to N+i including the additional part(s) N+i.

The tone-generation process of the input performance data is executed using the parts whose contents are being set as described above in accordance with the flowchart of FIG.

4. When a user presses a play switch SW1 within the function select switches 4*g* on the operation panel, the flowchart of FIG. 4 is started every time the musical tone synthesizing appparatus inputs performance data over the reception buffer channels, which correspond to the keyboard channels KBch1-KBchp from the keyboard 4*a*, sequencer channels SQch1-SQchq from the internal sequencer, or MIDI channels MIDIch1-MIDIchr from the MIDI device connected with the communication interface 7. In step P1, input performance data are divided into device information (i.e., KBch, SQch, MIDIch) representing each of channels, note number(s) and velocity information, which are obtained by the tone-generation instructor.

In step P2, the musical tone synthesizing apparatus searches through parts to find out a part related to connect information corresponding to the device information of the input performance data. That is, the apparatus detects the part corresponding to the input performance data. In this step P2, there is a possibility in which multiple parts are detected in connection with the input performance data. If multiple parts are detected, the apparatus initially selects a part having a smallest serial number within the detected parts.

In step P3, the tone-generation instructor obtains tone-generation setting information regarding prescribed items such as "tone color number", "tone volume" and "pitch" with respect to the part which is detected or selected. In step P4, it outputs the note number and velocity information of the input performance data, obtained from the performance input in the foregoing step P1, as well as the tone color number and tone-generation setting information obtained in the foregoing step P3 as output performance data. The output performance data are transferred to the tone generator 6, which is configured by a tone generator driver, a tone generator LSI device or a software tone generator, for example.

In step P5, the tone generator 6 secures a single tone-generation channel (e.g., LSI ch) per one part. Then, the tone generator 6 performs calculations using information of the tone color designated by the tone color number as well as the note number and velocity information of the output performance data. Thus, the tone generator 6 generates a musical tone signal in the tone-generation channel being presently secured. In step P6, the apparatus makes examination on all of the parts detected in the step P2 so as to make a decision as to whether there remains a part (or parts), which is not processed by the foregoing steps P3 to P5, or not. If the apparatus completes processing on all the detected parts, it ends the tone-generation process. If there remains the part(s) being un-processed, the apparatus reverts program control to step P3 by way of step P7. In step P3, the apparatus performs the steps P3 to P5 on the remaining part (or one of the remaining parts). Thereafter, if the step P6 determines that processing is completed with respect to all of the detected parts corresponding to the input performance data, the apparatus ends the tone-generation process.

[C] Tone Color Addition Detection Process

If an extended tone color is being added, the musical tone synthesizing apparatus of the present embodiment executes a routine of a tone color addition detection process. When starting the system, the apparatus automatically detects addition of the extended tone color, so that "1" is set to an addition flag, for example. Next, when an additional part N+i is designated in a tone color select/edit process, the apparatus additionally produces a tone-generation instructor in response to the addition of the extended tone color (i.e., "addition flag"=1) being detected. As for the additional part N+i, the apparatus selects a tone color number for the extended tone color within "m+1" to "m+k". This allows the apparatus to edit the extended tone color being selected.

Figure 6:
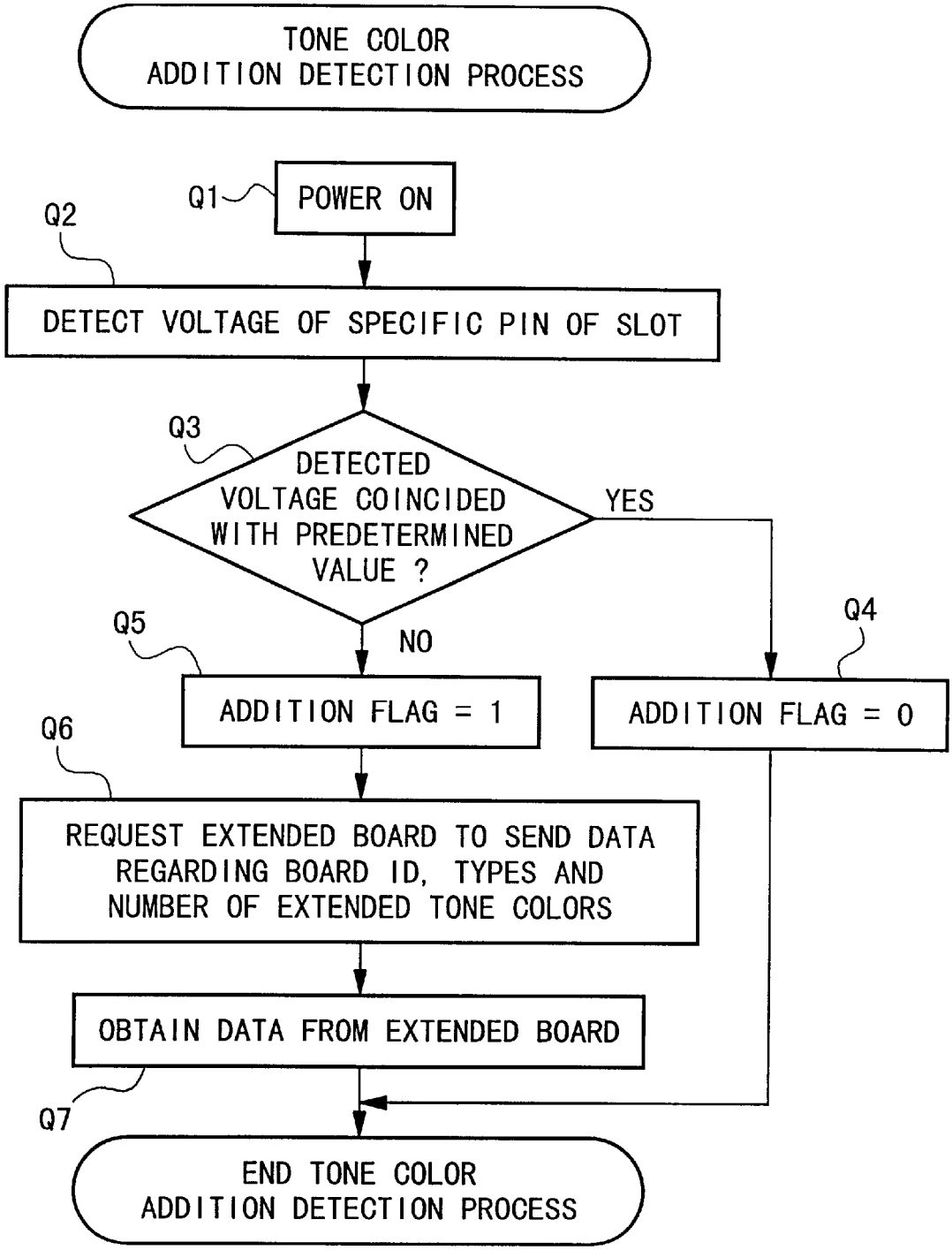
FIG. 6 is a flowchart showing a tone color addition detection process.

FIG. 6 is a flowchart showing the routine of the tone color addition detection process in accordance with the embodiment of the invention. In order to add tone colors using an extended board, the extended board is installed in the extended slot 10 normally under an initial condition where a power switch is turned off. Therefore, it is possible to automatically start the tone color addition detection process by pressing the power switch of the musical tone synthesizing apparatus ON. When such a power-on even is detected by step Q1, the apparatus transfers control to step Q2 to detect voltage being applied to a prescribed pin (e.g., extended-board-installation-detection pin) of the extended slot 10.

In step Q3, a decision is made as to whether the detected voltage coincides with a predetermined value (e.g., +5 volt) representing a non-installation condition of the extended board in the extended slot 10 or not. If the detected voltage coincides with the predetermined value, the apparatus transfers control to step Q4, in which "0" is set to the addition flag (AF) being set in the RAM 3. That is, the apparatus declares that no tone color is added. Then, the apparatus ends the tone color addition detection routine.

If the detected voltage does not coincide with the predetermined value but it corresponds to a shortcircuit value representing installation of the extended board in the extended slot 10, the apparatus transfers control to step Q5 from step Q3. In step Q5, "1" is set to the addition flag AF, which corresponds to a prescribed region of the RAM 3. Thus, the apparatus declares that the extended board is installed in the extended slot 10, so tone colors are being added. In step Q6, the main body of the apparatus requests the extended board to send data with regard to an ID (i.e., identification) of the extended board, i.e., types of extended tone colors and a number of extended tone colors as well as a number of "extensible" parts. In step Q7, the main body of the apparatus obtains those data from the extended board, so that the data are stored in a prescribed area of the RAM 3. Then, the apparatus ends the tone color addition detection process.

In the case of the software tone generator in which tone colors are being added in a software manner, starting an application program initiate a tone color check sum to detect addition of the tone colors in a software manner. Thus, even if the tone generator 6 is configured by the software tone generator, it is possible to sets an "extension" flag, which is similar to the aforementioned addition flag used in the tone color addition detection process.

[D] Tone Color Select/edit Process

Figure 7:
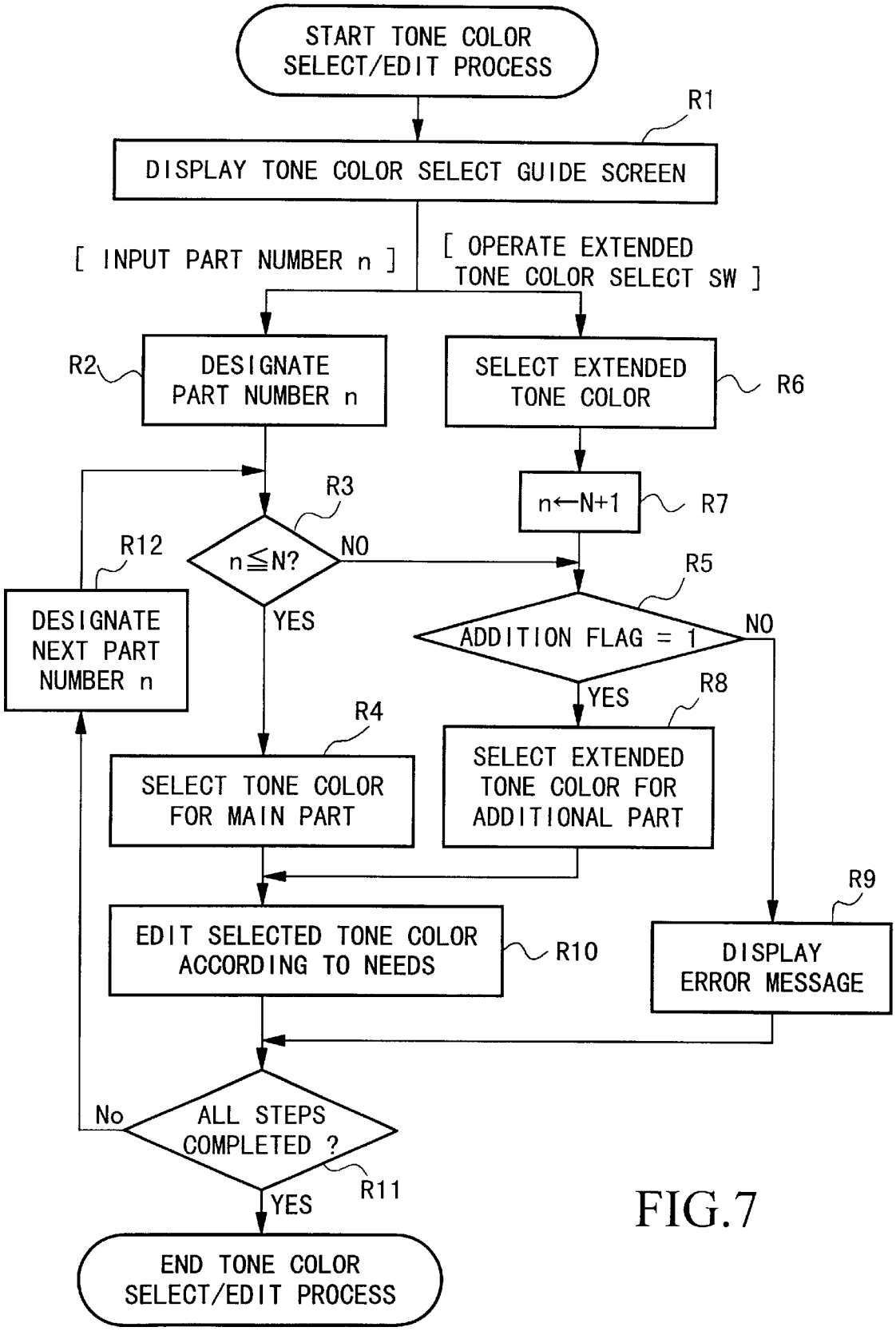
FIG. 7 is a flowchart showing a tone color select/edit process.

FIG. 7 is a flowchart showing a tone color select/edit process in accordance with the embodiment of the invention. The tone color select/edit process is started by pressing a tone color select mode switch within the voice operators 4*h* on the operation panel, for example. In step R1, the display 5*d* displays an image of a tone color select guide screen (not shown), which urges the user to input "part number (n)" or perform manual operations for selection of extended tone colors, on a screen thereof. Thus, the user is urged to press or operate some switches and keys initially for starting selection of the part(s). Namely, the user presses the keypads of the ten-key unit 4*d* to selectively designate some part by inputting a part number "n", which is commonly used with respect to main parts (i.e., preset parts of the main body) and additional parts. Or, the user is capable of operating an extended tone color select switch within the voice operators 4*h* to selectively designate the additional part only.

To input the part number n, the user operates the numeric keypads of the ten-key unit 4*d* to selectively designate the part number n in step R2. Then, the musical tone synthesizing apparatus transfers control to step R3. In step R3, a decision is made as to whether the designated part number n belongs to a range of main part numbers 1 to N or not. Herein, if "n" meets a condition of "1≦n≦N" so that the user designates a certain main part number, the apparatus transfers control from step R3 to step R4. In step R4, the apparatus performs a tone color select process with respect to the main part corresponding to the designated main part number. If n>N so that the user designates an additional part number, a decision result of the step R3 is "NO", so that the apparatus transfers control to step R5.

When the user operates the extended tone color select switch to select only the additional part, the apparatus directly transfers control from step R1 to step R6. In step R6, the apparatus automatically designates an additional part by "n". In step R7, a new number N+1 (i.e., first additional part number) is substituted for the part number n. Then, the apparatus proceeds to step R5.

The step R5 corresponds to extended tone color addition detection for detecting addition of the extended tone color. Herein, a decision is made, with reference to the addition flag being set to the RAM 3, as to whether the addition flag is set at "1 or not. If the addition flag is set at "1", the apparatus transfers control to step R8, in which an extended tone color (whose tone color number ranges from "m+1" to "m+k") is selected from among the stored tone colors with respect to the additional part. In this case, a process for selecting the extended tone color can be executed at a high speed by using the foregoing data of the extended board, which have been already transferred to the RAM 3.

If the apparatus selects the extended tone color at first in the step R5, it is possible to automatically provide a prescribed default value with the tone-generation setting information regarding the extended tone color. If the addition flag is not set at "1", the apparatus transfers control from step R5 to step R9. In the step R9, the apparatus displays an error message indicating non-assignment of the extended tone color on a screen of the display 5*d*.

Figure 8:
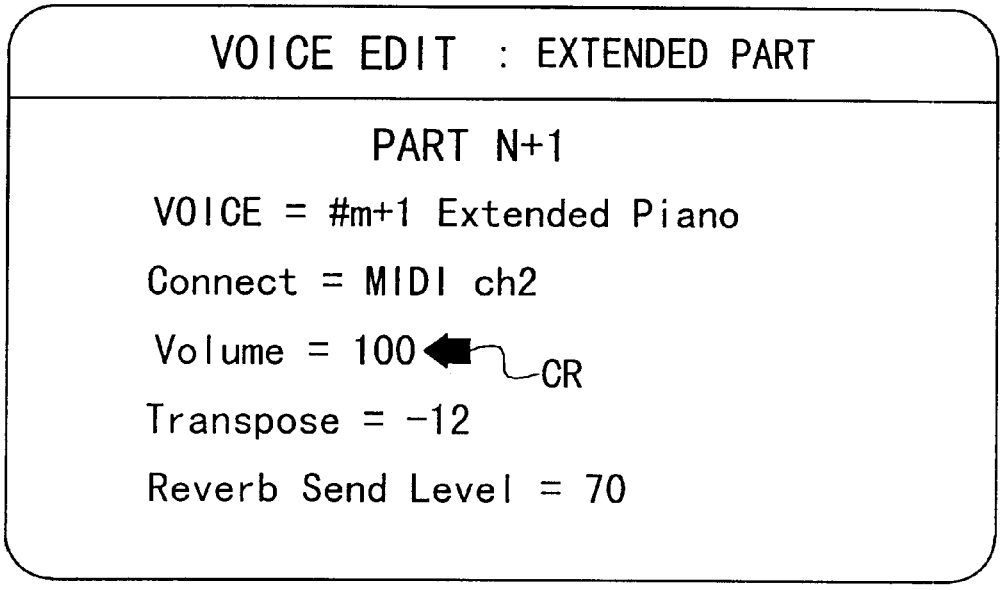
FIG. 8 shows an example of a tone color edit screen which is displayed in accordance with the tone color select/edit process.

After completion of the aforementioned steps R4, R8 each of which contributes to selection of the (extended) tone color, when the user presses a tone color edit mode switch within the voice operators 4*h* on the operation panel, the apparatus proceeds to step R10. In step R10, the apparatus displays an image of a tone color edit screen on the screen of the display 5*d* with respect to the part being currently selected. An example of the tone color edit screen is shown in FIG. 8. Using the tone color edit screen, the user is capable of editing the tone color. In the example of FIG. 8, the user is capable of setting the tone color information and tone-generation setting information by operating the cursor switches 4*c* and keypads of the ten-key unit 4*d* on the operation panel. That is, the user operates the cursor switches 4*c* to move a cursor "CR" to designate a certain location regarding the information, content of which is being changed, on the screen. With respect to the designated information, the user operates the numeric keypads of the ten-key unit 4*d* to correct its predefined value or default value to a desired setting value. As described above, edit data are created with respect to the extended tone color, which is subjected to tone color edit process in the step R4 or R8 and the step R10. The edit data are stored as "extended tone color edit data" in an extended tone color edit area of the extended board, which is installed in the extended slot 10.

After completion of the step R4 or R8 and the step R10, the apparatus proceeds to step R11, in which the apparatus makes a decision whether to end the tone color select/edit process with respect to the part, designated by the present part number "n", or not. If a decision result is "YES", the apparatus ends the tone color select/edit process. If "NO", the apparatus transfers control to step R12, in which the user is urged to designate a next part number, corresponding a part being processed next, by operating the numeric keypads, an increment key (INC) and a decrement key (DEC) of the ten-key unit 4*d*. Then, the apparatus reverts control to step R3 again. Thus, the aforementioned steps R3 to R11 are similarly effected on the next part. Lastly, the decision result of the step R11 becomes "YES", so that the apparatus ends the tone color select/edit process.

Incidentally, the software tone generator for adding the extended tone color in a software manner can work as similar to the aforementioned hardware tone generator. That is, the software tone generator is also capable of editing the extended tone color. Herein, extended tone color edit data are made based on edit data, which are created by editing the extended tone color being added in the software manner. Such extended tone color edit data are stored in an extended tone color edit area, which is set in advance in connection with extended tone colors by the software tone generator (6).

[E] Extended Tone Color Save/load Process

As described before, the extended tone color edit data being edited are stored in the extended board installed in the extended slot 10. There is a probability in that the extended board is frequently inserted into and extracted from the extended slot 10. For this reason, the manufacture does not normally guarantee safety in retaining stored contents of the extended board. This can be also said to the extended tone color edit data, which are made by editing the extended tone color being added in a software manner by the software tone generator. That is, there is a probability in that the above extended tone color edit data are stored in a certain storage area, stored contents of which are not always guaranteed.

To cope with the aforementioned disadvantage, the present embodiment is designed to automatically save the extended tone color edit data in external storage media such as semiconductor memory cards, as follows:

That is, at completion of editing the extended tone colors or at a power-off event or at completion of application programs in the case of the software tone generator, all the extended tone color edit data, which are made by editing the extended tone colors, are read out and are stored in the external storage media collectively. Herein, the extended tone color edit data are stored together with an ID of the extended board or an ID of the extended tone color. At a power-on event, the apparatus automatically detects the corresponding external storage media on the basis of the ID of the extended board installed in the extended slot 10 or the ID of the extended tone color which are extended in the software manner by the software tone generator. Thus, the extended tone color edit data which are previously edited are read out from the detected external storage media and are transferred to the extended board or else.

Specifically, extended tone color edit data, which are made by editing the extended tone colors, are saved in the external storage device (7) together with an ID of an extended tone generator. Then, the extended tone color edit data being saved in the external storage device are automatically loaded to the extended tone generator based on the ID of the extended tone generator when the apparatus starts the system to run. By automatically saving and loading the extended tone color edit data, it is possible to well manage the edit data of the extended tone colors without causing a delete of data.

Figure 9:
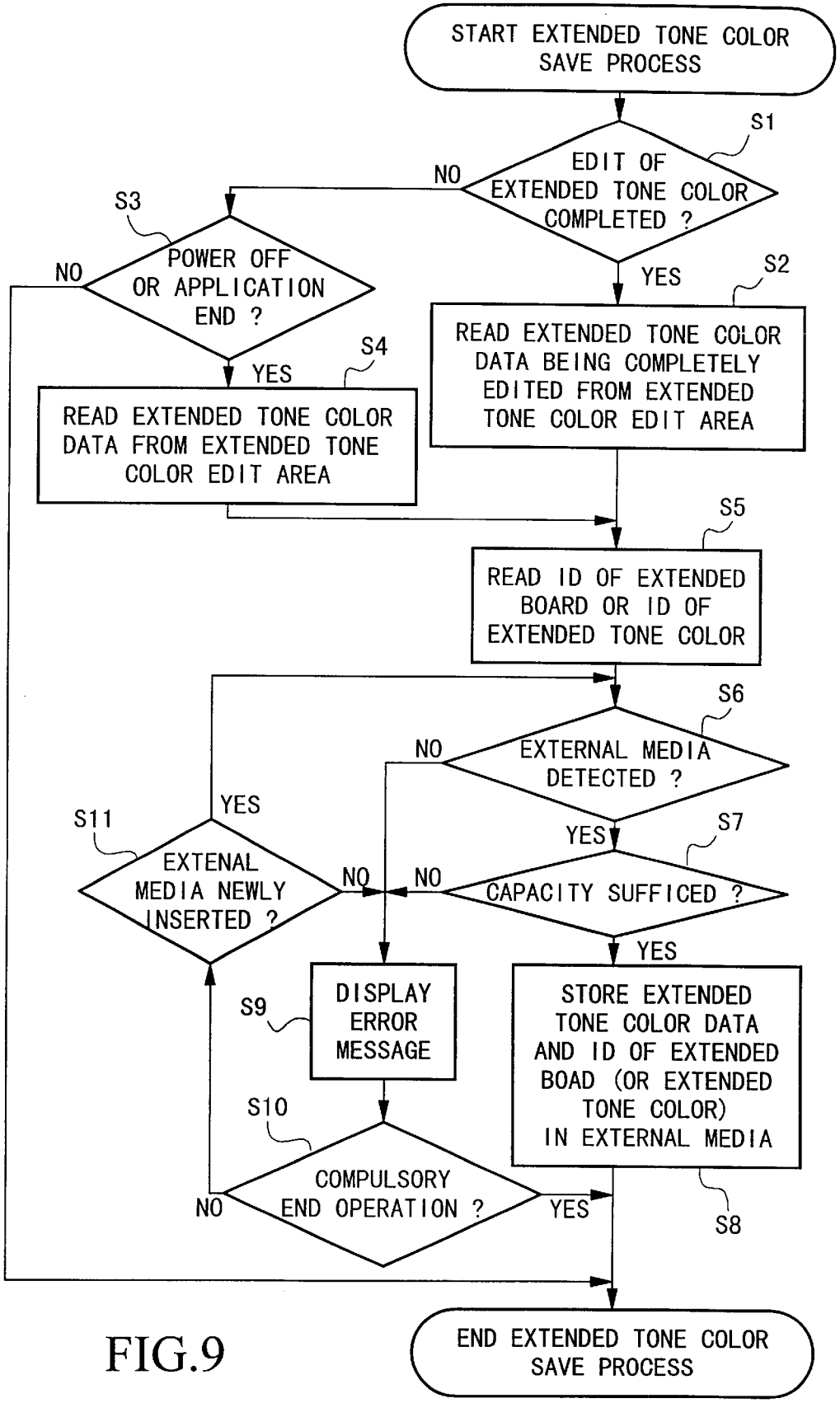
FIG. 9 is a flowchart showing an extended tone color save process.
Figure 10:
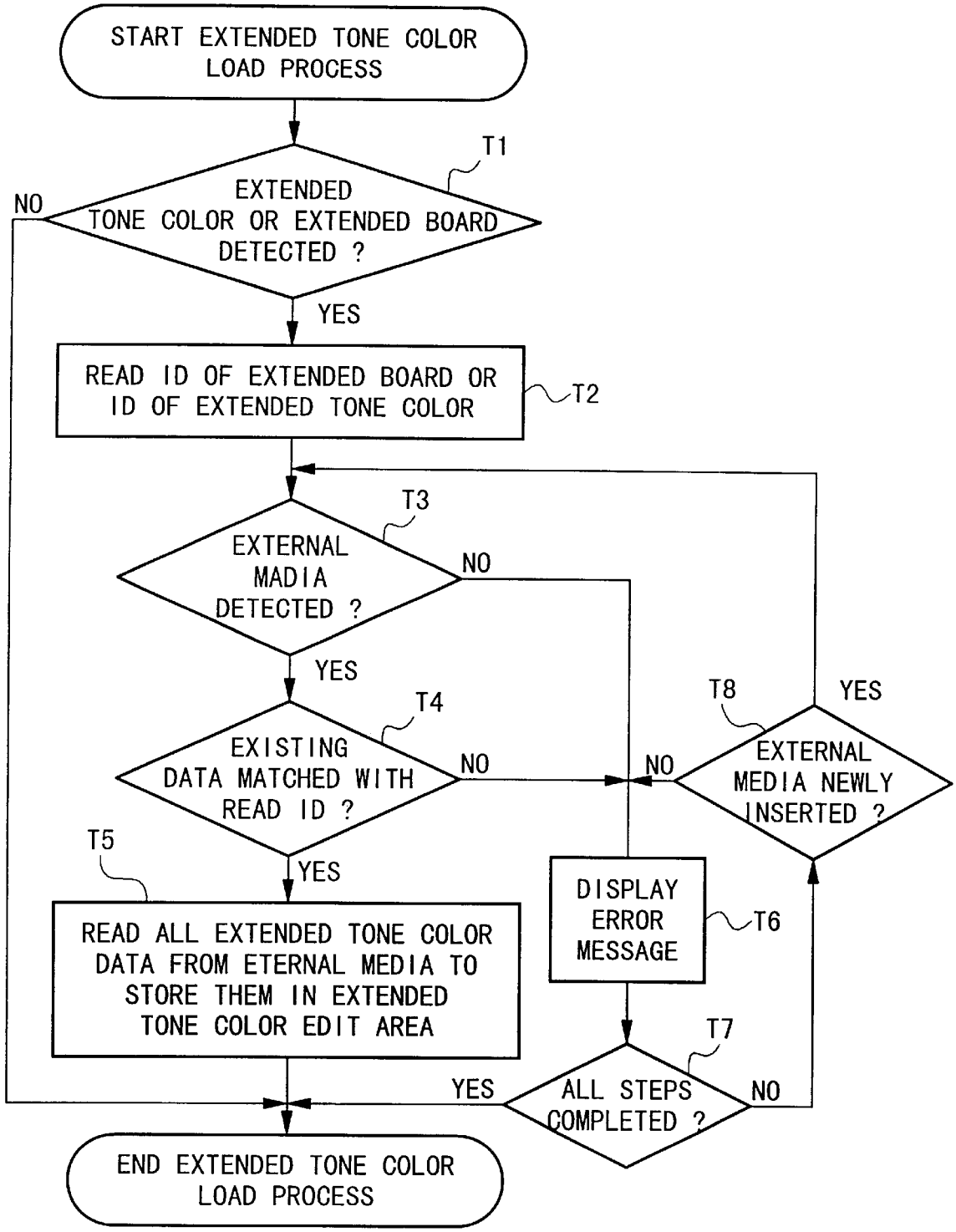
FIG. 10 is a flowchart showing an extended tone color load process.

FIGS. 9 and 10 show flowcharts being created in accordance with the embodiment of the invention. Namely, FIG. 9 shows a flowchart of an extended tone color save process, and FIG. 10 shows a flowchart of an extended tone color load process. The extended tone color save process of FIG. 9 is started by step S1, in which a decision is made as to whether edit of the extended tone color is completed or not. If the edit of the extended tone color is completed, the musical tone synthesizing apparatus transfers control to step S2, in which the extended tone color edit data being completely edited are read from the extended tone color edit area. If the edit of the extended tone color is not completed, the apparatus transfers control to step S3, in which a decision is made as to whether a power-off process is made or not, or a decision is made as to whether the software tone generator ends an extended tone color edit application program or not. If a decision result of the step S3 is "YES", the apparatus proceeds to step S4 in which all of extended tone color edit data including new extended tone color edit data, which are created by editing the extended tone color, are read from the extended tone color edit area. If "NO", the apparatus ends the extended tone color save process.

After completion of the steps S2, S4, the apparatus proceeds to step S5 to read out an ID of the extended board or an ID of the extended tone color (in case of the software tone generator). In step S6, detection is made as to whether the external storage media is being installed (or inserted) in the musical tone synthesizing apparatus or not. If the external storage media is inserted into the apparatus, examination is made in step S7 as to whether the inserted external storage media has a sufficient storage capacity or not. If the storage capacity of the external storage media suffices the needs, the apparatus proceeds to step S8. In step S8, the extended tone color edit data, which are read out by the aforementioned step S2 or S4, and the ID of the extended board or ID of the extended tone color, which is read out by the step S5, are saved on the external storage media such as the semiconductor memory card. Herein, the extended tone color edit data and the ID are paired together and are saved on the external storage media.

If the step S6 detects non-insertion of the external storage media, or if the step S7 detects shortage of the storage capacity of the external storage media, the apparatus transfers control to step S9. In step S9, the apparatus displays an error message indicating the non-insertion of the external storage media or shortage of the storage capacity of the external storage media on the screen of the display 5*d*. Then, the apparatus proceeds to step S10 in which an examination is made as to whether a compulsory end operation is made or not. If the compulsory end operation is made, the apparatus ends the extended tone color save process. If not, the apparatus proceeds to step S11 in which detection is made as to whether an external storage media is newly inserted or not. When detecting new insertion of the external storage media, the apparatus reverts control back to step S6 again. Thus, the aforementioned steps S6 to S10 are effected with respect to the external storage media newly inserted. If no external storage media is newly inserted, the apparatus reverts control back to step S9 again. Hence, the aforementioned steps S9, S10 are being repeated. Lastly, a decision result of the step S10 becomes "YES", so that the apparatus ends the extended tone color save process.

Lastly, a description will be given with respect to the extended tone color load process with reference to FIG. 11. At a power-on event or when the user selects the extended tone color being added by the extended board or software (e.g., step R8 of the tone color select/edit process shown in FIG. 7), the extended tone color load process is automatically started or is activated by a system menu (not shown). In this case, it is possible to load the extended tone color edit data whose edit is completed and which are stored on the external storage media. In step T1, detection is made as to whether an extended board is inserted into the extended slot 10 or not, or detection is made as to whether an extended tone color is added in a software manner or not. When detecting insertion of the extended board or addition of the extended tone color, the apparatus proceeds to step T2 to read an ID of the extended board or an ID of the extended tone color. The RAM 3 reads in such an ID. Then, the apparatus transfers control to step T3. Incidentally, if the step T1 fails to detect the insertion of the extended board or addition of the extended tone color, the apparatus immediately ends the extended tone color load process.

In step T3, detection is made as to whether an external storage media is inserted into the apparatus or not. When detecting insertion of the external storage media, the apparatus transfers control to step T4. In step T4, examination is made as to whether there exist extended tone color edit data, which match with the ID of the extended board or ID of the extended tone color being read by the aforementioned step T2, or not. If there exist the extended tone color edit data that match with the ID, the apparatus proceeds to step T5, in which all the extended tone color edit data are read from the external storage media and are stored in the extended tone color edit area. Then, the apparatus ends the extended tone color load process.

If the apparatus does not detect the external storage media in step T3, or if there exist no extended tone color edit data that match with the ID of the external board or ID of the extended tone color in step T4, the apparatus transfers control directly to step T6 to display the corresponding error message on the screen of the display 5*d*. In next step T7, a decision is made as to whether the extended tone color load process is being ended or not. If "YES", the apparatus ends the extended tone color load process. If not, the apparatus proceeds to step T8.

In step T8, detection is made as to whether an external storage media is newly inserted into the apparatus or not. When detecting new insertion of the external storage media, the apparatus reverts control to step T3 again. Thus, the aforementioned steps T3 to T7 are effected with respect to the external storage media newly inserted. Because of the aforementioned process, even if the apparatus does not initially detect the external storage media corresponding to the extended tone color(s), it is possible to automatically load the extended tone color edit data by later insertion of the media. If the step T8 detects that no external storage media is newly inserted into the apparatus, the apparatus proceeds back to the foregoing steps T6, T7. Lastly, a decision result of the step T7 becomes "YES", so that the apparatus ends the extended tone color load process.

Incidentally, the extended tone color load process of FIG. 10 is made in such a way that prior to the step T3 for detection of the external storage media, the apparatus detects the extended board or extended tone color in step T1. Of course, it is possible to modify the extended tone color load process such that detection of the external storage media is firstly made, then, detection of the extended board or extended tone color is made. Such modification can be easily actualized by moving the steps T1, T2 to locate between the steps T3 and T4.

The present embodiment describes the musical tone synthesizing apparatus basically in a form of a hardware system or apparatus installing the foregoing programs. Of course, this invention is not necessarily limited to such hardware structure but is actualized by software processing. For example, substantially all parts of the musical tone synthesizing apparatus can be realized using a personal computer or else, in which they are displayed on a screen so that the user operates them with clicks of a mouse or else. In that case, programs actualizing the parts of the musical tone synthesizing apparatus are provided by storage medium such as floppy disks, compact disks and the like, or they are provided and downloaded from some computer networks such as Internet. Specifically, the present embodiment can be redesigned to exclude the memories as the storage of information (e.g., performance data and programs), so that necessary information is provided by way of MIDI terminals from the Internet, for example.

Lastly, this invention has a variety of technical features, which are summarized as follows:

(1) The musical tone synthesizing apparatus of this invention is basically configured using performance inputs, tone-generation instructors to which tone colors are being properly set. Herein, the tone-generation instructors generate output performance data having the tone colors based on input performance data being input by the performance inputs.

(2) The musical tone synthesizing apparatus is designed to allow a further increase of the tone-generation instructor(s) in response to addition of a tone color (or tone colors) being detected. Herein, it is possible to selectively set the added tone color(s) to the increased tone-generation instructor(s). In other words, it is possible to automatically produce an additional part in response to an extended tone color number. So, it is possible to selectively set an extended tone color for the additional part.

(3) Assignment of tone colors can be made in such a way that all tone color numbers including the extended tone color number(s) are newly assigned again with respect to main parts and additional part(s). Thus, it is possible to actualize comprehensive tone color setting.

(4) An extended tone color provider (e.g., extended board) additionally provides the apparatus with extended tone colors, each of which is set to the tone-generation instructor. Herein, extended tone color edit data are created by editing the extended tone color. So, the extended tone color edit data are stored in some external storage device (e.g., semiconductor memory card) together with information (e.g., ID) specifying the extended tone color provider. Then, the extended tone color edit data are loaded to the extended tone color provider on the basis of the information stored in the external storage device. Therefore, when the user intends to extend the tone colors, it is possible to well manage the extended tone colors and their data because the extended tone color edit data, which are made by editing the extended tone colors, can be safely retained without being deleted.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical tone synthesizing apparatus comprising:

a plurality of performance inputs, each of which inputs performance data with respect to a specific source for generating musical tones;

a plurality of tone-generation instructors, to which the plurality of performance inputs are assigned respectively and to which a plurality of tone colors are set, so that the plurality of tone-generation instructors generate output performance data respectively having the plurality of tone colors on the basis of the performance data being input to the plurality of performance inputs;

a tone color addition detector for detecting addition of at least one tone color; and a tone-generation instructor extender for enabling an extension of a tone-generation instructor in response to the addition of the at least one tone color being detected.

2. A musical tone synthesizing apparatus according to claim 1 further comprising a tone color selector for selecting the tone color being added with respect to the tone-generation instructor being extended.

3. A musical tone synthesizing apparatus according to claim 1 wherein the tone-generation instructor corresponds to a part.

4. A musical tone synthesizing apparatus according to claim 1 wherein the source corresponds to a keyboard, a sequencer or a MIDI instrument or device.

5. A musical tone synthesizing apparatus according to claim 1 further comprising a tone generator for generating musical tone signals based on the output performance data.

6. A musical tone synthesizing method comprising the steps of:

providing a plurality of performance inputs, each of which inputs performance data with respect to a specific source for generating musical tones;

assigning the plurality of performance inputs to a plurality of tone-generation instructors, to which a plurality of tone colors are set respectively, so that the plurality of tone-generation instructors generate output performance data respectively having the plurality of tone colors on the basis of the performance data being input to the plurality of performance inputs;

detecting at least one tone color being added; and enabling an extension of a tone-generation instructor in response to the added tone color being detected.

7. A musical tone synthesizing method according to claim 6 wherein the tone-generation instructor corresponds to a part, while the source corresponds to a keyboard, a sequencer, or a MIDI instrument or device.

8. A musical tone synthesizing apparatus comprising:

a plurality of performance inputs, each of which inputs performance data with respect to a specific source for generating musical tones;

a plurality of tone-generation instructors, to which the plurality of performance inputs are assigned respectively and to which a plurality of tone colors are set, so that the plurality of tone-generation instructors generate output performance data respectively having the plurality of tone colors on the basis of the performance data being input to the plurality of performance inputs;

an extended tone color provider for additionally providing at least one extended tone color;

an extended tone color editor for editing the extended tone color being set to a tone-generation instructor, which is extended or which is selected from among the plurality of tone-generation instructors, so that the extended tone color editor produces extended tone color edit data from an edit of the extended tone color; and a saver for saving the extended tone color edit data on an external storage device together with information specifying the extended tone color provider.

9. A musical tone synthesizing apparatus according to claim 8 further comprising a loader for loading the extended tone color edit data from the external storage device to the extended tone color provider, which is specified by the information stored in the external storage device.

10. A musical tone synthesizing apparatus according to claim 8 wherein the tone-generation instructor corresponds to a part.

11. A musical tone synthesizing apparatus according to claim 8 wherein the source corresponds to a keyboard, a sequencer, or a MIDI instrument or device.

12. A musical tone synthesizing apparatus according to claim 8 further comprising a tone generator for generating musical tone signals based on the output performance data.

13. A musical tone synthesizing apparatus according to claim 8 wherein the extended tone color provider corresponds to an extended board storing data regarding the extended tone color, while the external storage device corresponds to an external storage media such as a semiconductor memory card.

14. A musical tone synthesizing method comprising the steps of:

providing a plurality of performance inputs, each of which inputs performance data with respect to a specific source for generating musical tones;

assigning the plurality of performance inputs to a plurality of tone-generation instructors, to which a plurality of tone colors are set respectively, so that the plurality of tone-generation instructors generate output performance data respectively having the plurality of tone colors on the basis of the performance data being input to the plurality of performance inputs;

editing an extended tone color, which is additionally provided by an extended tone color provider and is set to a tone-generation instructor, which is extended or which is selected from among the plurality of tone-generation instructors;

producing extended tone color edit data from an edit of the extended tone color; and storing the extended tone color edit data in an external storage device together with information specifying the extended tone color provider.

15. A musical tone synthesizing method according to claim 14 wherein the tone-generation instructor corresponds to a part, while the source corresponds to a keyboard, a sequencer, or a MIDI instrument or device.

16. A musical tone synthesizing method according to claim 14 wherein the extended tone color provider corresponds to an extended board storing data regarding the extended tone color, while the external storage device corresponds to an external storage media such as a semiconductor memory card.

17. A musical tone synthesizing apparatus comprising:

a plurality of performance inputs for inputting performance data;

a plurality of tone-generation instructors, to which the plurality of performance inputs are assigned respectively and to which a plurality of tone colors are set, so that the plurality of tone-generation instructors generate output performance data respectively having the plurality of tone colors on the basis of the performance data being input to the plurality of performance inputs;

a tone color addition detector for detecting addition of at least one tone color; and a tone-generation instructor extender for extending a tone-generation instructor in response to the addition of the at least one tone color being detected.

18. A musical tone synthesizing apparatus according to claim 17 further comprising a performance operator, an overall area of which is divided into a plurality of registers, so that performance data being produced from at least one of the plurality of registers are assigned to the extended tone-generation instructor.

19. A musical tone synthesizing apparatus according to claim 17 further comprising a sequencer having a plurality of tracks, so that performance data being produced from at least one of the plurality of tracks are assigned to the extended tone-generation instructor.

20. A musical tone synthesizing apparatus according to claim 17 further comprising a communication interface for performing communications with an external device that is capable of generating performance data over a plurality of channels, so that performance data being received over at least one of the plurality of channels are assigned to the extended tone-generation instructor.

21. A musical tone synthesizing apparatus according to claim 17 further comprising a performance operator for generating first performance data, a sequencer for generating second performance data, and a communication interface for performing communications with an external device that is capable of generating third performance data, so that one of the first, second and third performance data is selectively assigned to one of the plurality of tone-generation instructors and the extended tone-generation instructor.

22. A musical tone synthesizing apparatus according to claim 17 wherein the added tone color is set selectively to any one of the plurality of tone-generation instructors and the extended tone-generation instructor.

23. A musical tone synthesizing apparatus according to claim 17 further comprising an extended slot that is capable of installing a sound board storing data regarding the added tone color, so that the tone color addition detector detects installation of the sound board into the extended slot.

24. A musical tone synthesizing method comprising the steps of:

providing a plurality of performance inputs for inputting performance data;

assigning the plurality of performance inputs to a plurality of tone-generation instructors, to which a plurality of tone colors are set, so that the plurality of tone-generation instructors generate output performance data respectively having the plurality of tone colors on the basis of the performance data being input to the plurality of performance inputs;

detecting an addition of at least one tone color; and extending a tone-generation instructor in response to the addition of the at least one tone color being detected.

25. A musical tone synthesizing method according to claim 24 wherein the tone-generation instructor corresponds to a part, while the performance input receiving the performance data from a keyboard, a sequencer, or a MIDI instrument or device.

26. A machine-readable media storing programs and data that cause a musical tone synthesizing apparatus to perform a musical tone synthesizing method comprising the steps of:

providing a plurality of performance inputs, each of which inputs performance data with respect to a specific source for generating musical tones;

assigning the plurality of performance inputs to a plurality of tone-generation instructors, to which a plurality of tone colors are set respectively, so that the plurality of tone-generation instructors generate output performance data respectively having the plurality of tone colors on the basis of the performance data being input to the plurality of performance inputs;

detecting at least one tone color being added; and enabling an extension of a tone-generation instructor in response to the added tone color being detected.

27. A machine-readable media storing programs and data that cause a musical tone synthesizing apparatus to perform a musical tone synthesizing method comprising the steps of:

providing a plurality of performance inputs, each of which inputs performance data with respect to a specific source for generating musical tones;

assigning the plurality of performance inputs to a plurality of tone-generation instructors, to which a plurality of tone colors are set respectively, so that the plurality of tone-generation instructors generate output performance data respectively having the plurality of tone colors on the basis of the performance data being input to the plurality of performance inputs;

editing an extended tone color, which is additionally provided by an extended tone color provider and is set to a tone-generation instructor, which is extended or which is selected from among the plurality of tone-generation instructors;

producing extended tone color edit data from an edit of the extended tone color; and storing the extended tone color edit data in an external storage device together with information specifying the extended tone color provider.

28. A machine-readable media storing programs and data that cause a musical tone synthesizing apparatus to perform a musical tone synthesizing method comprising the steps of:

providing a plurality of performance inputs for inputting performance data;

assigning the plurality of performance inputs to a plurality of tone-generation instructors, to which a plurality of tone colors are set, so that the plurality of tone-generation instructors generate output performance data respectively having the plurality of tone colors on the basis of the performance data being input to the plurality of performance inputs;

detecting an addition of at least one tone color; and extending a tone-generation instructor in response to the addition of the at least one tone color being detected.

* * * * *